US008660470B2

(12) United States Patent
Watanabe et al.

(10) Patent No.: US 8,660,470 B2
(45) Date of Patent: Feb. 25, 2014

(54) DEVELOPING DEVICE AND IMAGE FORMING APPARATUS INCLUDING THE SAME

(75) Inventors: Yoichi Watanabe, Kanagawa (JP); Makoto Hirota, Kanagawa (JP); Tomoyuki Yoshii, Kanagawa (JP); Jun Abe, Kanagawa (JP); Yasuaki Watanabe, Kanagawa (JP); Shinichi Kuramoto, Kanagawa (JP); Kunihiko Sato, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 65 days.

(21) Appl. No.: 13/491,200

(22) Filed: Jun. 7, 2012

(65) Prior Publication Data

US 2013/0164042 A1 Jun. 27, 2013

(30) Foreign Application Priority Data

Dec. 22, 2011 (JP) ..... 2011-281240

(51) Int. Cl.
*G03G 15/09* (2006.01)

(52) U.S. Cl.
USPC ..... 399/269; 399/274

(58) Field of Classification Search
USPC ..... 399/269, 274–277
See application file for complete search history.

(56) References Cited

U.S. PATENT DOCUMENTS

| | | | | |
|---|---|---|---|---|
| 7,502,579 | B2 * | 3/2009 | Mabuchi et al. | 399/267 |
| 8,331,832 | B2 * | 12/2012 | Ikeda et al. | 399/269 |
| 2006/0216069 | A1 | 9/2006 | Tsujita et al. | |

FOREIGN PATENT DOCUMENTS

| | | | |
|---|---|---|---|
| JP | 07-244431 | A | 9/1995 |
| JP | 2006-267891 | A | 10/2006 |

* cited by examiner

*Primary Examiner* — Hoang Ngo
(74) *Attorney, Agent, or Firm* — Sughrue Mion, PLLC

(57) ABSTRACT

A developing device includes first and second developer carriers facing each other in a facing region, a regulating member that regulates a layer thickness of developer, and a separation member. The first and second developer carriers respectively include first and second magnetic members that are respectively magnetized with first and second facing magnetic poles having opposite polarities. The separation member separates the developer so that the developer is supplied toward the first and second developer carriers. The separation member is disposed such that distances between the separation member and the first and second developer carriers are the smallest in a region in which a magnitude of a combined magnetic field of the first and second magnetic poles locally decreases as compared with a case where at least one of the first and second developer carriers is independently disposed due to interaction between the first and second facing magnetic poles.

6 Claims, 10 Drawing Sheets

DEVELOPING DEVICE AND IMAGE FORMING APPARATUS INCLUDING THE SAME

CROSS-REFERENCE TO RELATED APPLICATIONS

This application is based on and claims priority under 35 USC 119 from Japanese Patent Application No. 2011-281240 filed Dec. 22, 2011.

BACKGROUND

Technical Field

The present invention relates to a developing device and an image forming apparatus including the developing device.

SUMMARY

According to an aspect of the invention, a developing device includes a first developer carrier and a second developer carrier that are disposed so as to face an image carrier, the first and second developer carriers facing each other in a facing region with a small distance therebetween, the first and second developer carriers respectively including a first magnetic member and a second magnetic member that are respectively magnetized with a first facing magnetic pole and a second facing magnetic pole that are located in parts of the first and second magnetic members in the facing region, the first and second facing magnetic poles having opposite polarities, and a first cylindrical member and a second cylindrical member that are respectively disposed around outer peripheries of the first and second magnetic members, the first and second cylindrical members rotating in opposite directions from the facing region toward the image carrier; a regulating member that regulates a layer thickness of developer that is supplied to at least one of the first and second developer carriers; and a separation member that separates the developer, whose layer thickness has been regulated by the regulating member, so that the developer is supplied toward the first developer carrier and toward the second developer carrier. The separation member is disposed such that distances between the separation member and the first and second developer carriers are the smallest in a region in which a magnitude of a combined magnetic field of the first and second facing magnetic poles of the first and second developer carriers locally decreases as compared with a case where at least one of the first and second developer carriers is independently disposed due to interaction between the first and second facing magnetic poles, the region being determined by analyzing the combined magnetic field.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described with reference to the drawings.

First Exemplary Embodiment

Figure 2:
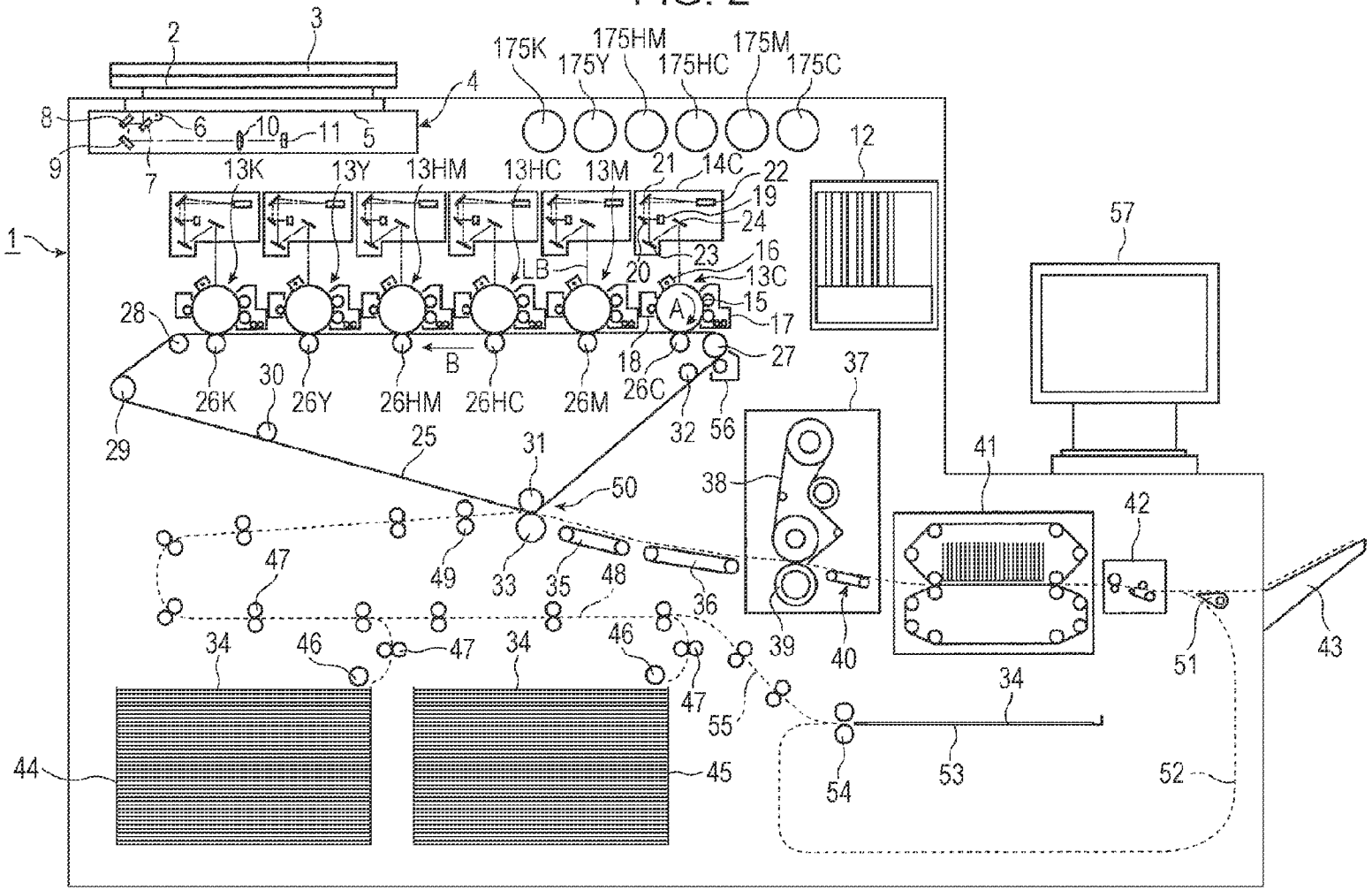
FIG. 2 is a schematic view of an image forming apparatus including the developing device according to the first exemplary embodiment of the present invention.

FIG. 2 illustrates a tandem full-color image forming apparatus including a developing device according to a first exemplary embodiment of the present invention. The tandem full-color image forming apparatus includes an image reader, so that the apparatus also functions as a full-color copier. However, the image reader may be omitted. The full color image forming apparatus is a high-speed machine that is capable of forming images on a large number of sheets per unit time. For example, the image forming apparatus is capable of forming images on A4 long edge feed (LEF) recording sheets at a speed of about 120-140 pages per minute (PPM). However, the present invention is applicable not only to a high-speed tandem image forming apparatus but also to a single-color image forming apparatus including only one photoconductor drum.

In FIG. 2, an image reader 4, which reads an image of a document 2, is disposed in an upper end portion (upper left end portion in this example) of an image forming apparatus body 1. In the image reader 4, the document 2 is irradiated with light emitted by a light source 6 while the document 2 is placed on a platen glass 5 and is pressed by a document pressing member 3. Light reflected from the document 2 passes through a reduction optical system, which includes a full-rate mirror 7, half-rate mirrors 8 and 9, and an imaging lens 10; and the light is scanned over an image reading element 11 such as a CCD. Thus, the image reading element 11 reads an image of the document 2 with a predetermined dot pitch.

The image of the document 2, which has been read by the image reader 4, is sent to a controller 12 as, for example, three-color image data of red (R), green (G), and blue (B) (for example, 8-bit for each color). The controller 12 includes an image processor and the like. The controller 12 performs, on the image data of the document 2, predetermined image processing operations such as shading correction, displacement correction, brightness/color conversion, gamma correction, frame erasing, and color/movement edition. After performing the predetermined image processing operations on the image data, the controller 12 converts the image data to four-color image data of cyan (C), magenta (M), yellow (Y), and black (K). The colors of image data converted by the controller 12 are not limited to the four colors, which are cyan (C), magenta (M), yellow (Y), and black (K). As described below, the colors may be six colors including high-chroma cyan (HC) and high-chroma magenta (HM). The number of colors may be any appropriate number. Image data may be input to the controller 12 through a communication line (not shown) from a personal computer or the like.

The present exemplary embodiment includes plural image forming units that form images by using toners of different colors.

That is, as illustrated in FIG. 2, in the image forming apparatus body 1 according to the present exemplary embodiment, six image forming units 13C, 13M, 13HC, 13HM, 13Y, and 13K, which respectively correspond to cyan (C), magenta (M), high-chroma cyan (HC), high-chroma magenta (HM), yellow (Y), and black (K) are parallelly arranged along a horizontal direction at a regular pitch. High-chroma cyan (HC) has a cyan hue and is more vivid than cyan (C). High-chroma magenta (HM) has a magenta hue and is more vivid than magenta (M).

The image forming units for cyan (C), magenta (M), high-chroma cyan (HC), high-chroma magenta (HM), yellow (Y), and black (K) may be arranged in an order different from that of FIG. 2. Each of the image forming units 13C, 13M, 13HC, 13HM, 13Y, and 13K for cyan (C), magenta (M), high-chroma cyan (HC), high-chroma magenta (HM), yellow (Y), and black (K) is an integrated unit. The image forming units 13C, 13M, 13HC, 13HM, 13Y, and 13K are independently removable from the image forming apparatus body 1.

As illustrated in FIG. 2, the six image forming units 13C, 13M, 13HC, 13HM, 13Y, and 13K have the same structure except for the type (color) of toner used. Each of the image forming units includes a photoconductor drum 15, a scorotron 16, an image exposure device 14, a developing device 17, and a cleaning device 18. The photoconductor drum 15, which is an example of an image carrier, is driven at a predetermined rotation speed (for example, about 800 mm/sec) in the direction of arrow A. The scorotron 16, which is an example of a first charger, uniformly charges a surface of the photoconductor drum 15. The image exposure device 14, which is an example of a latent image forming unit, exposes the surface of the photoconductor drum 15 so as to form an electrostatic latent image of a corresponding color. The developing device 17, which is an exposure device according to the present exemplary embodiment, develops the electrostatic latent image formed on the photoconductor drum 15 by using toner of the corresponding color. The cleaning device 18 removes residual toner and the like remaining on the photoconductor drum 15.

As illustrated in FIG. 2, each of the image exposure devices 14 modulates a semiconductor laser 19 in accordance with image data and emits a laser beam LB from the semiconductor laser 19 in accordance with the image data. The laser beam LB, which has been emitted by the semiconductor laser 19, is reflected by reflection mirrors 20 and 21 and deflection-scanned by a rotating polygon mirror 22. Then, the focal length of the laser beam LB is adjusted by an f-θ lens (not shown) in accordance with the scanning angle, the laser beam LB is reflected by reflection mirrors 23 and 24 and the like, and the surface of the photoconductor drum 15, which is an example of an image carrier, is exposed to light in a scanning manner. The image exposure device 14 is not limited to a device that performs exposure by deflection-scanning a laser beam LB. For example, an image exposure device including an LED array, in which LEDs are arranged in the axial direction of the photoconductor drum 15, may be used. In this case, because the size of an image exposure device 14 including an LED array is considerably smaller than an image exposure device 14 that deflection-scans a laser beam, the entirety of the image forming apparatus may be reduced in size.

The controller 12 successively outputs image data of corresponding colors to the image exposure devices 14C, 14M, 14HC, 14HM, 14Y, and 14K of the image forming units 13C, 13M, 13HC, 13HM, 13Y, and 13K for cyan (C), magenta (M), high-chroma cyan (HC), high-chroma magenta (HM), yellow (Y), and black (K). The image exposure devices 14C, 14M, 14HC, 14HM, 14Y, and 14K emit laser beams LB in accordance with the image data; the surfaces of the corresponding photoconductor drums 15C, 15M, 15HC, 15HM, 15Y, and 15K are scanned by the laser beams in the main scanning direction (the axial direction of the photoconductor drum); and thereby electrostatic latent images are formed on the surfaces of the photoconductor drums 15C, 15M, 15HC, 15HM, 15Y, and 15K. The developing devices 17C, 17M, 17HC, 17HM, 17Y, and 17K develop the electrostatic latent images, which have been formed on the photoconductor drums 15C, 15M, 15HC, 15HM, 15Y, and 15K, to form toner images composed of negatively charged toners of cyan (C), magenta (M), high-chroma cyan (HC), high-chroma magenta (HM), yellow (Y), and black (K). In FIG. 2, a numeral 15 and a numeral 17 are placed near only the image forming unit 13C for cyan (C), instead of showing numerals 15C, 15M, 15HC, 15HM, 15Y, 15K, 17C, 17M, 17HC, 17HM, 17Y, and 17K near the corresponding image forming units 13M, 13HC, 13HM, 13Y, and 13K for magenta (M), high-chroma cyan (HC), high-chroma magenta (HM), yellow (Y), and black (K).

As illustrated in FIG. 2, an intermediate transfer belt 25, which is an example of an intermediate transfer member, is disposed below the image forming units 13C, 13M, 13HC, 13HM, 13Y, and 13K. The toner images of cyan (C), magenta (M), high-chroma cyan (HC), high-chroma magenta (HM), yellow (Y), and black (K), which have been successively formed on the photoconductor drums 15C, 15M, 15HC, 15HM, 15Y, and 15K of the image forming units 13C, 13M, 13HC, 13HM, 13Y, and 13K are overlappingly first-transferred to the intermediate transfer belt 25 by first transfer rollers 26C, 26M, 26HC, 26HM, 26Y, and 26K.

The intermediate transfer belt 25 is looped over plural rollers with a predetermined tension. The plural rollers include a driving roller 27, a driven roller 28, a tension roller 29, a driven roller 30, a back-support roller 31 disposed in the second transfer region, and a driven roller 32. The driving roller 27 is rotated by a dedicated driving motor (not shown) that is capable of rotating at a highly constant speed. The intermediate transfer belt 25 is driven by the driving roller 27 in the direction of arrow B at a predetermined speed that is substantially the same as the rotation speed (circumferential speed) of the photoconductor drums 15C, 15M, 15HC, 15HM, 15Y, and 15K. The intermediate transfer belt 25 is, for example, an endless-belt-shaped synthetic resin film that is made from a plastic resin, such as a polyimide resin or a polyamide-imide resin, and whose resistance value is adjusted.

A second transfer roller 33 is in pressed contact with the back-support roller 31 with the intermediate transfer belt 25 therebetween, and a second transfer bias voltage is applied to the second transfer roller 33. The toner images of cyan (C), magenta (M), high-chroma cyan (HC), high-chroma magenta (HM), yellow (Y), and black (K), which have been overlappingly transferred to the intermediate transfer belt 25, are simultaneously second-transferred to a recording sheet 34, which is an example of a recording medium, due to the application of the second transfer voltage. After the toner images of the four colors have been transferred, the recording sheet 34 is transported by a pair of transport belts 35 and 36 to a fixing device 37, which is an example of a fixing unit. The fixing device 37 fixes the toner images, which have been transferred to the recording sheet 34, onto the recording sheet 34 by applying heat and pressure using a heating belt 38 and a pressure roller 39. The recording sheet 34 is transported by a sheet transport unit 40 to a cooling unit 41, where the recording sheet 34 is cooled. Then, a curl correction unit 42 corrects a curl of the recording sheet 34; and in the case of one-side printing, the recording sheet 34 is output to an output tray 43 that is disposed outside of the image forming apparatus body 1. The fixing device 37 may include a heating roller instead of the heating belt 38. The cooling unit 41 and the curl correction unit 42 may be omitted.

As illustrated in FIG. 2, the recording sheet 34, which has a predetermined size and quality, is picked up from one of feed trays 44 and 45 so as to be separated from other sheets, and the recording sheet 34 is transported to a registration roller 49 along a sheet transport path 48, along which a feed roller 46 and pairs of transport rollers 47 are arranged. The recording sheet 34, which has been supplied from one of the feed trays 44 and 45, is transported to a second transfer position 50 by the registration roller 49, which is rotated at a predetermined timing, in synchronism with the toner images on the intermediate transfer belt 25.

When forming images on two sides of the recording sheet 34, the recording sheet 34 is not output to the outside of the image forming apparatus after the toner image has been fixed onto one side of the recording sheet 34 by the fixing device 37. Instead, a switching gate 51 switches a transport path of the recording sheet 34 to a reverse sheet transport path 52, which is disposed in a lower part of the image forming apparatus, and the recording sheet 34 is transported to an intermediate tray 53 by feed rollers 54 and temporarily held on the intermediate tray 53. The recording sheet 34, which has been turned upside down, is transported by the feed rollers 54 from the intermediate tray 53 in the opposite direction through a two-side sheet transport path 55 and the sheet transport path 48 to the second transfer position 50 of the intermediate transfer belt 25. At the second transfer position, a toner image is transferred to the back side of the recording sheet 34. The fixing device 37 fixes the toner image onto the back side of the recording sheet 34 by applying heat and pressure using the heating belt 38 and the pressure roller 39. The recording sheet 34 is transported by the sheet transport unit 40 to the cooling unit 41, where the recording sheet 34 is cooled. Then, the curl correction unit 42 corrects a curl of the recording sheet 34, and the recording sheet 34 is output to the output tray 43 that is disposed outside of the image forming apparatus body 1.

The cleaning devices 18 clean the surfaces of the photoconductor drums 15 from which the toner image have been first-transferred. A belt cleaning device 56, which is disposed in the vicinity of the driving roller 27, cleans the surface of the intermediate transfer belt 25 from which the toner images have been second-transferred.

A user inputs the conditions of an image forming operation and the like through a user interface 57 illustrated in FIG. 2.

Figure 1:
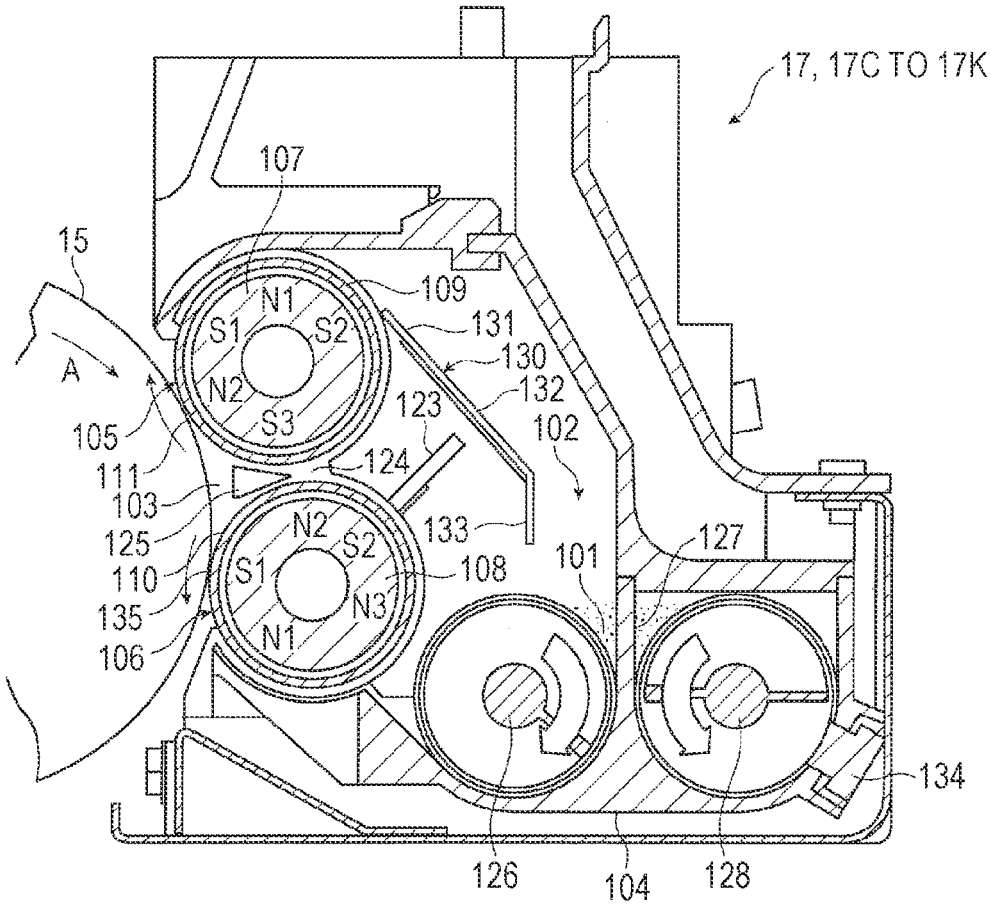
FIG. 1 a schematic sectional view of a developing device according to a first exemplary embodiment of the present invention.

FIG. 1 is a sectional figure of one of the developing devices 17C to 17K included in the image forming apparatus.

As illustrated in FIG. 1, the developing device 17 includes a developing device body 104 that has a developer containing portion 102 in a lower part thereof and an opening 103 formed in one side thereof (the left side in FIG. 1). The developer containing portion 102 contains two-component developer 101 composed of carrier and toner. First and second development rollers 105 and 106, which are examples of first and second developer carriers, are each disposed inside of the opening 103 of the developing device body 104 so as to face the surface of the photoconductor drum 15 with a predetermined distance (in the range of about 0.5 to 1.0 mm) therebetween. The first and second development rollers 105 and 106 are arranged adjacent to each other in the vertical direction so as to face each other with a small distance (for example, of several millimeters) therebetween. The first and second development rollers 105 and 106 respectively include first and second magnet rollers 107 and 108 and first and second development sleeves 109 and 110. The first and second magnet rollers 107 and 108, which are examples of first and second magnetic members, are disposed so as to be fixed in the first and second development rollers 105 and 106. The first and second development sleeves 109 and 110, which are examples of first and second cylindrical members, are disposed around the outer peripheries of the first and second magnet rollers 107 and 108 so as to be rotatable in the directions of arrows.

Figure 3:
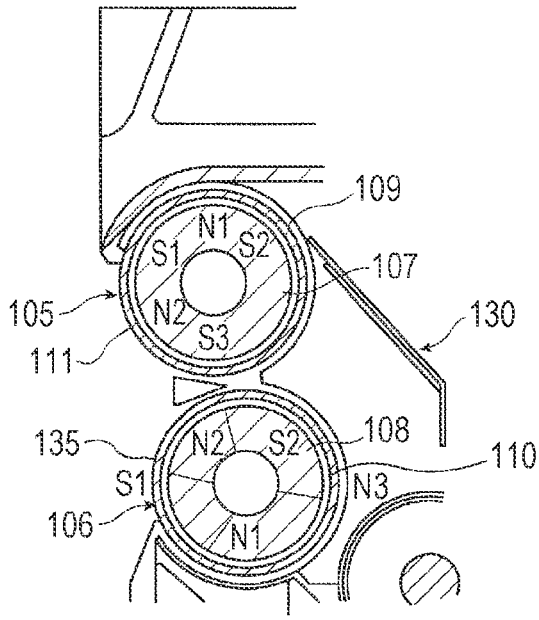
FIG. 3 is a schematic sectional view illustrating the arrangement of magnetic poles of first and second development rollers of the developing device according to the first exemplary embodiment of the present invention.
Figure 4:
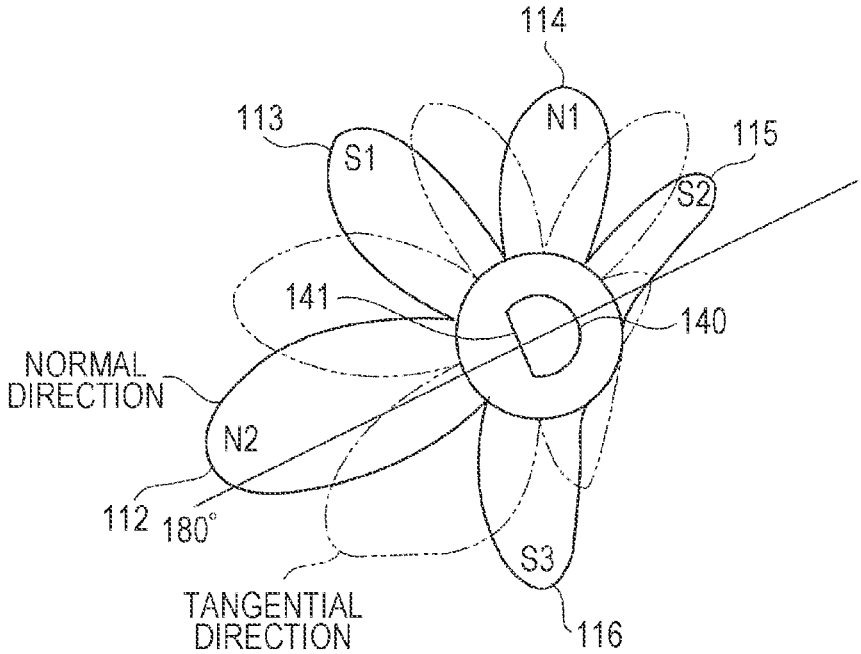
FIG. 4 is a graph illustrating the magnetic flux density distribution of a first magnet roller of the developing device according to the first exemplary embodiment of the present invention.

The first and second magnet rollers 107 and 108 are cylindrical, made from a magnetic material including a ferromagnetic substance or the like, and fixed to the developing device body 104. The first magnet roller 107 of the first development roller 105 is disposed upstream of the second magnet roller 108 in the rotation direction of the photoconductor drum 15. As illustrated in FIGS. 3 and 4, the first magnet roller 107 is magnetized so as to have a second north pole N2 112, a first south pole S1 113, a first north pole N1 114, a second south pole S2 115, and a third south pole S3 116. The second north pole N2 112, which serves as a developing magnetic pole, is disposed in a developing region 111 in which the first development roller 105 faces the photoconductor drum 15 with a small distance therebetween. The first south pole S1 113, which serves as a transport magnetic pole and transports the developer 101, is disposed downstream of the second north pole N2 112 in the rotation direction of the first development sleeve 109. The first north pole N1 114, which serves as a transport magnetic pole and transports the developer 101, is disposed downstream of the first south pole S1 113 in the rotation direction of the first development sleeve 109. The second south pole S2 115, which serves as a transport magnetic pole and transports the developer 101, is disposed downstream of the first north pole N1 114 in the rotation direction of the first development sleeve 109. The third south pole S3 116, which serves as a peel-off magnetic pole and peels the developer 101 off the surface of the first development sleeve 109 in cooperation with the second south pole S2 115, is disposed downstream of the second south pole S2 115 in the rotation direction of the first development sleeve 109. The third south pole S3 116 serves as a transport magnetic pole and transports the developer 101 to the second north pole N2 112, which serves as a developing magnetic pole.

In FIG. 4, each of solid lines represents the magnetic flux density of a corresponding one of the magnetic poles of the first magnet roller 107 in the normal direction of the magnetic pole, and each of broken lines represents the magnetic flux density of a corresponding one of the magnetic poles of the first magnet roller 107 in the tangential direction of the magnetic pole.

As illustrated in FIG. 4, the second north pole N2 112, the first south pole S1 113, the first north pole N1 114, the second south pole S2 115, and the third south pole S3 116 are arranged along the circumferential direction of the first magnet roller 107 with predetermined angles therebetween with reference to a reference position (180°) that is located slightly upstream of the second north pole N2 112, which serves as a developing magnetic pole, in the rotation direction of the first development sleeve 109. The first magnet roller 107 is magnetized so that these poles have predetermined magnetic flux densities. As illustrated in FIG. 4, the first magnet roller 107 is set such that a reference surface 141 of an end of a shaft 140 having a D-shaped cross section is oriented toward the second north pole N2 112, which is a developing magnetic pole.

Figure 5:
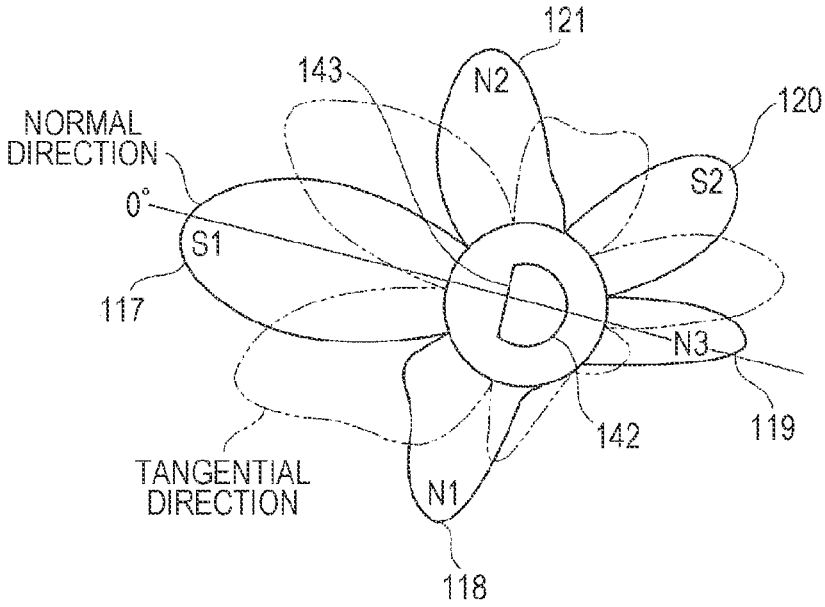
FIG. 5 is a graph illustrating the magnetic flux density distribution of a second magnet roller of the developing device according to the first exemplary embodiment of the present invention.

The second magnet roller 108 of the second development roller 106 is disposed downstream of the first magnet roller 107 in the rotation direction of the photoconductor drum 15. As illustrated in FIGS. 3 and 5, the first magnet roller 107 is magnetized so as to have a first south pole S1 117, a first north pole N1 118, a third north pole N3 119, a second south pole S2 120, and a second north pole N2 121. The first south pole S1 117, which serves as a developing magnetic pole, is disposed in a developing region 135 in which the second development roller 106 faces the photoconductor drum 15 with a small distance therebetween. The first north pole N1 118, which serves as a transport magnetic pole and transports the developer 101, is disposed downstream of the first south pole S1 117 in the rotation direction of the second development sleeve 110. The third north pole N3 119, which serves as a peel-off magnetic pole and peels the developer 101 off the surface of the second development sleeve 110 in cooperation with the first north pole N1 118, is disposed downstream of the first north pole N1 118 in the rotation direction of the second development sleeve 110. The second south pole S2 120, which serves as a transport magnetic pole and transports the developer 101, is disposed downstream of the third north pole N3 119 in the rotation direction of the second development sleeve 110. The second north pole N2 121, which serves as a transport magnetic pole and transports the developer 101, is located downstream of the second south pole S2 120 in the rotation direction of the second development sleeve 110 in a facing region 124 in which the first and second development rollers 105 and 106 face each other with a small distance therebetween. The second north pole N2 121 serves as a transport magnetic pole and transports the developer 101 to the first south pole S1 117, which serves as a developing magnetic pole.

In FIG. 5, each of solid lines represents the magnetic flux density of a corresponding one of the magnetic poles of the second magnet roller 108 in the normal direction to the magnetic pole, and each of broken lines represents the magnetic flux density of a corresponding one of the magnetic poles of the second magnet roller 108 in the tangential direction of the magnetic pole.

As illustrated in FIG. 5, the first south pole S1 117, the first north pole N1 118, the third north pole N3 119, the second south pole S2 120, and the second north pole N2 121 are arranged along the circumferential direction of the second magnet roller 108 with predetermined angles therebetween with reference to a reference position (0°) that is located slightly upstream of the first south pole S1 117, which serves as a developing magnetic pole, in the rotation direction of the second development sleeve 110. The second magnet roller 108 is magnetized so that these poles have predetermined magnetic flux densities. As illustrated in FIG. 5, the second magnet roller 108 is set such that a reference surface 143 of an end of a shaft 142 having a D-shaped cross section is oriented toward the first south pole S1 117, which is a developing magnetic pole.

In the present exemplary embodiment, five magnetic poles are arranged along the circumferential direction of each of the first and second magnet rollers 107 and 108. However, the number of magnetic poles arranged along the circumferential direction of each of the first and second magnet rollers 107 and 108 is not limited to five, and may be, for example, seven.

As illustrated in FIG. 1, the first and second development sleeves 109 and 110 are cylindrical, made from a non-magnetic material such as aluminium or a stainless steel, and rotatably attached to the developing device body 104. The first development sleeve 109 rotates at a predetermined speed in a direction (indicated by an arrow in FIG. 1) the same as the rotation direction of the photoconductor drum 15. The second development sleeve 110 is rotated at a predetermined speed in a direction opposite to the rotation direction of the photoconductor drum 15. As a result, the surface of the first development sleeve 109 moves in a direction opposite to the movement direction of the photoconductor drum 15 at a position at which the first development sleeve 109 faces the photoconductor drum 15. The surface of the second development sleeve 110 moves in a direction the same as the movement direction of the photoconductor drum 15 at a position at which the second development sleeve 110 faces the photoconductor drum 15. The rotation speed (circumferential speed) of the first development sleeve 109 is higher than that of the second development sleeve 110. For example, the ratio of the speed of the first development sleeve 109 to that of the second development sleeve 110 is, for example, in the range of about 1.2 to 1.8.

As a result, when developing an electrostatic latent image formed on the photoconductor drum 15, the ratio of contribution of the first development roller 105, which is disposed on the upstream side in the rotation direction of the photoconductor drum 15, to the development to contribution of the second development roller 106, which is disposed on the downstream side in the rotation direction of the photoconductor drum 15, to the development is about 7:3. The first development roller 105 serves to improve reproduction of a thin line, and the second development roller 106 serves to improve reproduction of gradation.

As illustrated in FIG. 1, a trimming member 123 is disposed near a position at which the second development sleeve 110 faces the second south pole S2 120 of the second magnet roller 108. The trimming member 123 faces the surface of the second development sleeve 110 with a predetermined distance therebetween. The trimming member 123, which includes a flat metal plate made from a non-magnetic material such as aluminium or a stainless steel, regulates the amount of the developer 101 that is supplied to the second development sleeve 110. The trimming member 123 is an example of a regulating member. The trimming member 123 not only regulates the amount of the developer 101 that is supplied to the second development roller 106 but also regulates the amount of the developer 101 that is supplied to the first development roller 105.

A separation member 125 is disposed between the facing region 124 and the developing regions 111 and 135. The facing region 124 is located at a position at which the first and the second development rollers 105 and 106 face each other with a small distance therebetween. The developing regions 111 and 135 are respectively located at positions at which the first development roller 105 and the second development roller 106 face the photoconductor drum 15. The separation member 125 separates the developer 101, which has been supplied to the surface of the second development roller 106, so that the developer 101 is supplied toward the first development roller 105 and toward the second development roller 106. The separation member 125 is made from a non-magnetic material and has a substantially isosceles triangle cross section. As described below, the separation member 125 is disposed at a predetermined position such that the separation member 125 faces the first development roller 105 and the second development roller 106 with predetermined distances therebetween.

As illustrated in FIG. 1, in the developing device body 104, a developer supply auger 126 is disposed on the back side of the second development roller 106 so as to be rotatable in the direction of an arrow. The developer supply auger 126, which is an example of a developer supply member, agitates and transports the developer 101, which is two-component developer including carrier and toner, contained in the developing device body 104; and supplies the developer 101 to the second development roller 106. A developer agitation-transport auger 128 is disposed on the back side of the developer supply auger 126 with a partition wall 127 therebetween so as to be rotatable in the direction of an arrow. The developer agitation-transport auger 128 agitates and transports the developer 101 so that the developer 101 is circulated around the developer agitation-transport auger 128 and the developer supply auger 126, and thereby charges the toner of the developer 101 by friction. Passages (not shown) are disposed at two ends of the partition wall 127 in the longitudinal direction, so that the developer 101 is circulated through the passages around the developer supply auger 126 and the developer agitation-transport auger 128. New developer 101, at least including toner, is supplied into the developing device body 104 through an upstream end portion of the developer agitation-transport auger 128 in the developer transport direction. In the present exemplary embodiment, new two-component developer 101 including carrier and toner is supplied by a developer supply member (not shown) to the upstream end portion of the developer agitation-transport auger 128 in the developer transport direction at a predetermined timing.

As illustrated in FIG. 1, a guide chute 130 is disposed in the developing device body 104. The guide chute 130, which is an example of a guide member, guides the developer 101 that has been peeled off the surface of the first development roller 105 to the developer supply auger 126. The guide chute 130 is made from a non-magnetic metal such as aluminium or a stainless steel, a synthetic resin material, or a composite material composed of a non-magnetic metal and a synthetic resin. At least a part of the surface of the guide chute 130 that contacts the developer 101 is formed as a non-magnetic flat plate. The guide chute 130 includes a distal end portion 131, a middle portion 132, and a proximal end portion 133. The distal end portion 131 is located near a part of the surface of the first development roller 105 corresponding to the peel-off pole of the first development roller 105. The middle portion 132 is formed as a flat plate that is continuous with the distal end portion 131 and that is inclined at a predetermine angle (for example, in the range of about 45° to 50°) with respect to the horizontal direction. The proximal end portion 133, which is shorter than the distal end portion 131 and the middle portion 132, is located above the developer supply auger 126 and is bent substantially downward in the vertical direction toward the developer supply auger 126. Alternatively, the proximal end portion 133 of the guide chute 130 may be located above the developer supply auger 126 without being bent toward the developer supply auger 126.

As illustrated in FIG. 1, a toner concentration sensor 134 is disposed in a side wall of a developer passage of the developing device body 104 in which the developer agitation-transport auger 128 is disposed. The toner concentration sensor 134 detects the concentration of toner in the developer 101 contained in the developing device body 104.

As illustrated in FIG. 1, in the developing device 17, the developer supply auger 126 and the developer agitation-transport auger 128 agitate and transport the developer 101 contained in the developing device body 104, so that the toner in the developer 101 becomes negatively charged due to friction. The developer supply auger 126 supplies the developer 101 to the surface of second development roller 106.

The developer 101, which has been supplied to the surface of the second development roller 106, is transported in a counterclockwise direction by transport magnetic poles including the third north pole N3 119 and the second south pole S2 120, as the second development sleeve 110 rotates. The trimming member 123 regulates the layer thickness of the developer 101, and the developer is transported to the facing region 124, in which the first and second development rollers 105 and 106 face each other with a small distance therebetween. Then, the separation member 125, which is disposed in the facing region 124 or in the vicinity of the facing region 124, separates the developer 101 so that the developer 101 is supplied toward the first development roller 105 and toward the second development roller 106. The developer 101 separated so as to be supplied toward the first development roller 105 is transported by the transport magnetic poles including the third south pole S3 116 and the second north pole N2 112 in a clockwise direction as the first development sleeve 109 rotates. Then, the developer 101 reaches the developing region 111, in which the first development roller 105 faces the surface of the photoconductor drum 15. The second north pole N2 112, which serves as a developing magnetic pole, forms a magnetic brush of the developer 101, and thereby an electrostatic latent image on the surface of the photoconductor drum 15 is developed. Subsequently, as the first development sleeve 109 rotates, the developer 101 that is carried on the surface of the first development roller 105 is transported in the clockwise direction by transport magnetic poles including the second north pole N2 112 and the first south pole S1 113 and by transport magnetic poles including the first north pole N1 114 and the second south pole S2 115. The developer 101 is peeled off the surface of the first development sleeve 109 by peel-off magnetic poles including the second south pole S2 115 and the third south pole S3 116, which repel each other. Then, the second development roller 106 supplies new developer 101 to the surface of the development roller 105.

As illustrated in FIGS. 1 and 5, the developer 101 separated so as to be supplied toward the second development roller 106 is transported by the transport magnetic poles including the second north pole N2 121 and the first south pole S1 117 in the counterclockwise direction as the second development sleeve 110 rotates. Then, the developer 101 reaches the developing region 135, in which the second development roller 106 faces the surface of the photoconductor drum 15. The first south pole S1 117, which serves as a developing magnetic pole, forms a magnetic brush of the developer 101, and thereby an electrostatic latent image on the surface of the photoconductor drum 15 is developed. Subsequently, as the second development sleeve 110 rotates, the developer 101 carried on the surface of the second development roller 106 is transported in the counterclockwise direction by transport magnetic poles including the first south pole S1 117 and the first north pole N1 118. The developer 101 is peeled off the surface of the second development sleeve 110 by peel-off magnetic poles including the first north pole N1 118 and the third north pole N3 119, which repel each other. Then, the developer supply auger 126 supplies new developer 101 to the surface of the second development sleeve 110.

As illustrated in FIG. 1, the developer 101 that has been peeled off the surface of the first development roller 105 is guided by the guide chute 130 and drops onto the developer supply auger 126. The developer supply auger 126 agitates and transports the developer 101 together with the developer 101 that has been contained in the developing device body 104, and subsequently, the developer 101 is supplied to the surface of the second development roller 106. The rotation direction of the developer supply auger 126 (clockwise direction in FIG. 1) is opposite to that of the second development roller 106. Therefore, the developer 101 that has been peeled off the surface of the first development roller 105 is not immediately supplied to the surface of the second development roller 106. Instead, the developer 101 is transported by the developer supply auger 126 to a side opposite to a side on which the second development roller 106 is disposed, agitated together with the developer 101 contained in the developing device body 104, and then supplied to the surface of the second development roller 106.

As illustrated in FIG. 1, in the developing device 17, the first and second development rollers 105 and 106 are disposed so as to face each other with a small distance therebetween. The magnetic pole S3 116 and the magnetic pole N2 121, which are examples of first and second facing magnetic poles having opposite polarities, are disposed in the facing region 124, in which the first and second development rollers 105 and 106 face each other. The separation member 125 is disposed between the facing region 124, in which the first and second development rollers 105 and 106 face each other, and the developing regions 111 and 135, in which the first development roller 105 and the second development roller 106 respectively face the surface of the photoconductor drum 15. After the developer 101 has been supplied to the surface of the second development roller 106 and the trimming member 123 has regulated the layer thickness of the developer 101, the separation member 125 separates the developer 101 so that the developer 101 is supplied toward the first development roller 105 and toward the second development roller 106, and thereby the stress of the developer 101 is reduced.

With the structure described above, the layer thickness of the developer 101 that is separated by the separation member 125 so as to be supplied toward the first development roller 105 and toward the second development roller 106 may vary due to the influence of the facing magnetic poles S3 116 and N2 121 of the first and second development rollers 105 and 106.

Figure 6:
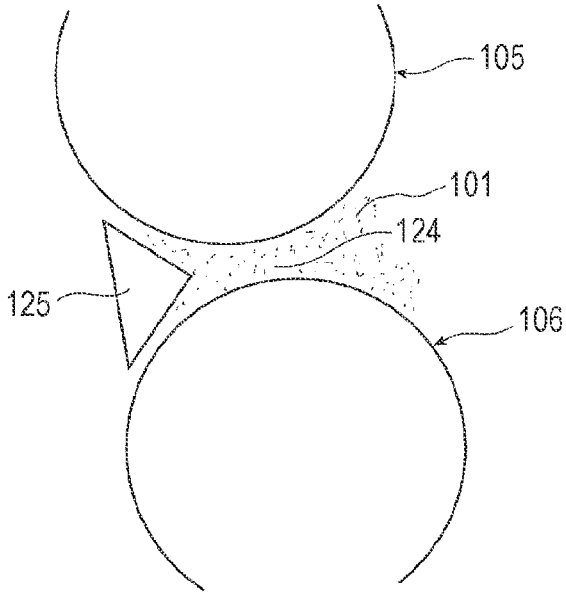
FIG. 6 RELATED ART
FIG. 6 is a schematic view illustrating a gap between the first and second development rollers according to related art.

FIG. 6 illustrates a model of a developing device according to related art. By using this model, time-varying changes in the layer thickness of the developer 101 that is separated by the separation member 125 so as to be supplied toward the first development roller 105 and toward the second development roller 106 are calculated using a discrete element method (DEM).

Figure 7:
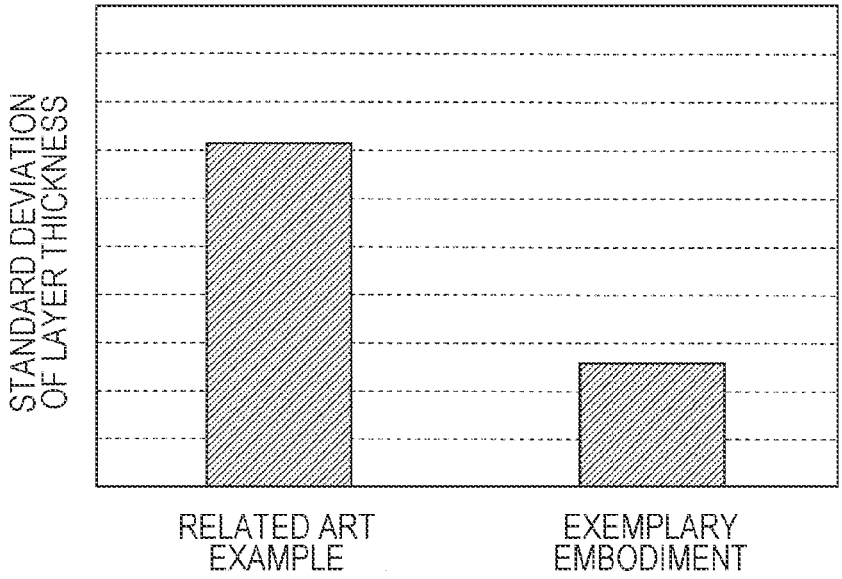
FIG. 7 is a graph illustrating the standard deviation of the developer layer thickness according to the exemplary embodiment and according to a related art example.

As a result, as illustrated in FIG. 7, the standard deviation of the layer thickness of the developer 101 that is carried on the surfaces of the first and second development rollers 105 and 106 is relatively large. This shows that the layer thickness of the developer 101 that is carried on the surfaces of the first and second development rollers 105 and 106 is considerably nonuniform, and therefore nonuniformity in the development concentration may occur.

Figure 8:
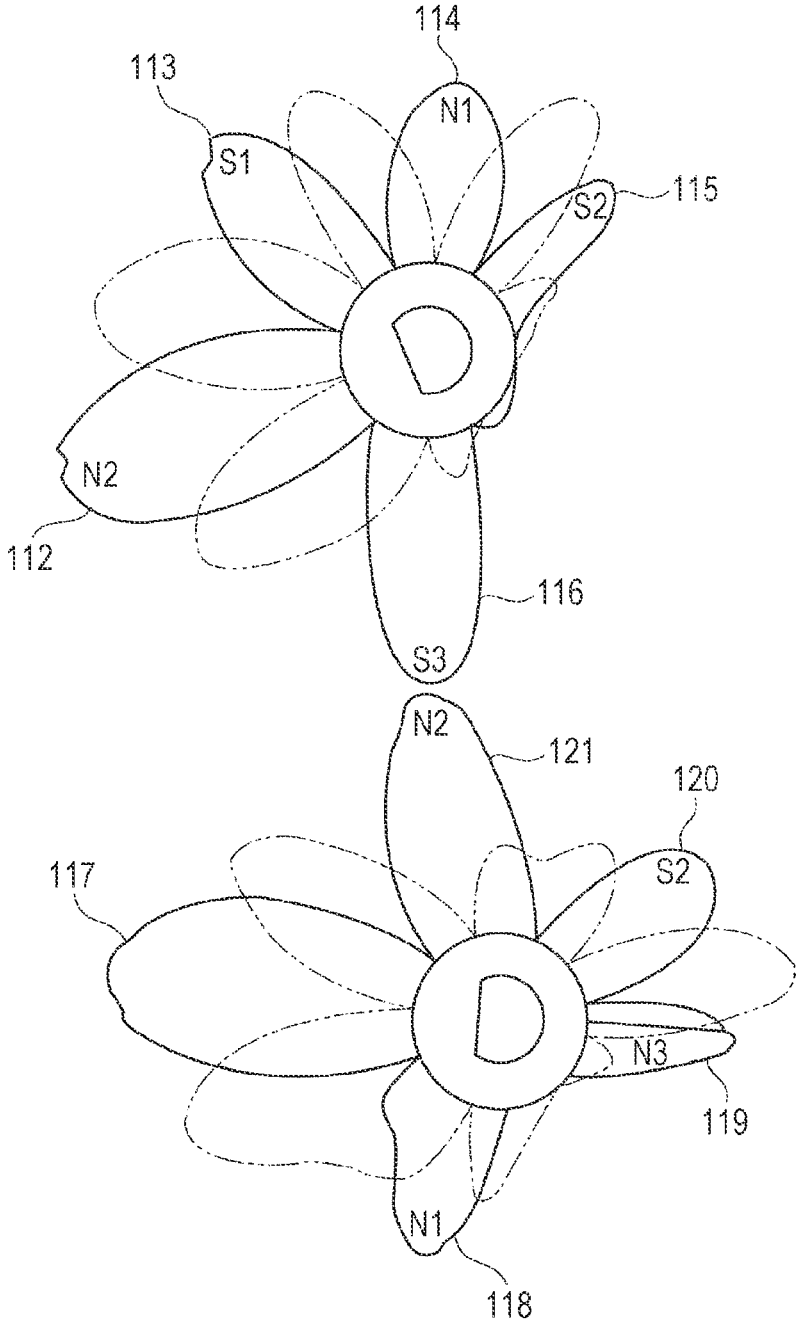
FIG. 8 is a graph illustrating the magnetic flux density distribution of the first and second magnet rollers of the developing device according to the first exemplary embodiment of the present invention.

An analysis is performed in order to prevent occurrence of nonuniformity in the layer thickness of the developer 101 that is carried on the surfaces of the first and second development rollers 105 and 106. The result of the analysis is as follows. In the developing device 17, as illustrated in FIG. 1, the first and second development rollers 105 and 106 are disposed adjacent to each other, and the facing magnetic poles S3 116 and N2 121, having opposite polarities, are disposed in the facing region 124, in which the first and second development rollers 105 and 106 face each other. Therefore, as illustrated in FIG. 8, in the developing device 17, the facing magnetic poles S3 116 and N2 121, having opposite polarities and disposed in the facing region 124, in which the first and second development rollers 105 and 106 face each other, interfere with each other. Thus, the magnetic fields formed in the facing region 124, in which the first and second development rollers 105 and 106 face each other, are changed from the magnetic fields illustrated in FIGS. 4 and 5, which are formed in the case where the first and second development rollers 105 and 106 are disposed independently.

To be specific, as illustrated in FIG. 8, the normal component of the magnetic flux density of the third south pole S3 116 of the first magnet roller 107 of the first development roller 105 is considerably increased toward the second development roller 106, and the normal component of the magnetic flux density of the second north pole N2 121 of the second magnet roller 108 of the second development roller 106 is considerably increased toward the first development roller 105. Moreover, due to the influence of such increase, the magnetic flux densities of the magnetic poles that are located adjacent to the third south pole S3 116 of the first magnet roller 107 and the second north pole N2 121 of the second magnet roller 108 are changed. Therefore, when the developer 101 passes through the facing region 124, in which the first and second development rollers 105 and 106 face each other, due to the change in the magnetic flux densities of the first and second magnet rollers 107 and 108, the developer 101 may move irregularly from the facing magnetic poles to adjacent magnetic poles or may drop from the first development roller 105 onto the second development roller 106 due to gravity, and thereby considerable nonuniformity of the layer thickness of the developer 101 separated so as to be supplied toward the first development roller 105 and toward the second development roller 106 may occur.

Figure 9:
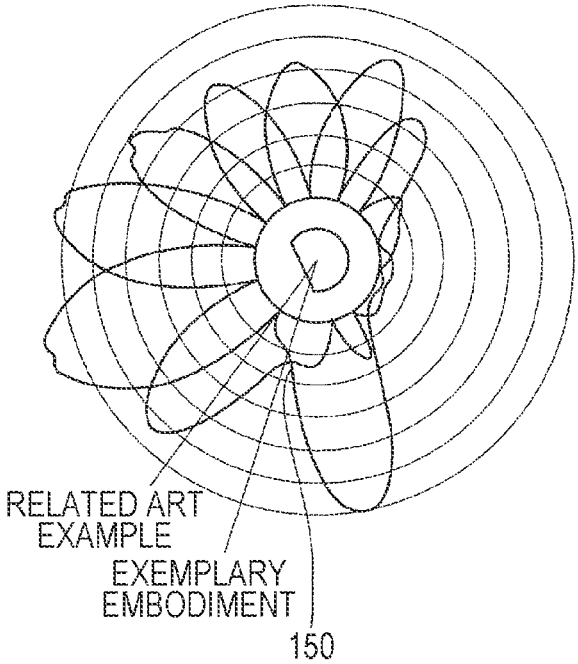
FIG. 9 is a graph illustrating the magnetic flux density distribution of the first magnet roller of the developing device according to the first exemplary embodiment of the present invention when the first and second development rollers are disposed adjacent to each other.

FIG. 9 is a graph illustrating in detail the magnetic flux density distribution of the first magnet roller 107 of the first development roller 105 when the first and second development rollers 105 and 106 are disposed adjacent to each other.

As is clear from FIG. 9, the magnetic flux density distribution of the first magnet roller 107 of the first development roller 105 has a region 150 in which the magnetic flux density distribution locally decreases considerably due to the influence of magnetic poles of the second magnet roller 108 of the second development roller 106. The region 150 is located downstream of the third south pole S3 116 of the first magnet roller 107 in the rotation direction of the first development sleeve 109.

For each of the cases illustrated in FIGS. 4 and 8, the absolute value of the magnetic flux density $|B|=\sqrt{[(Br)^2+(Bt)}$ $^2$] along the circumferential direction of the first magnet roller 107 of the first development roller 105 is calculated. Here, Br is the normal component of the magnetic flux density, and Bt is the tangential component of the magnetic flux density.

Figure 10A:
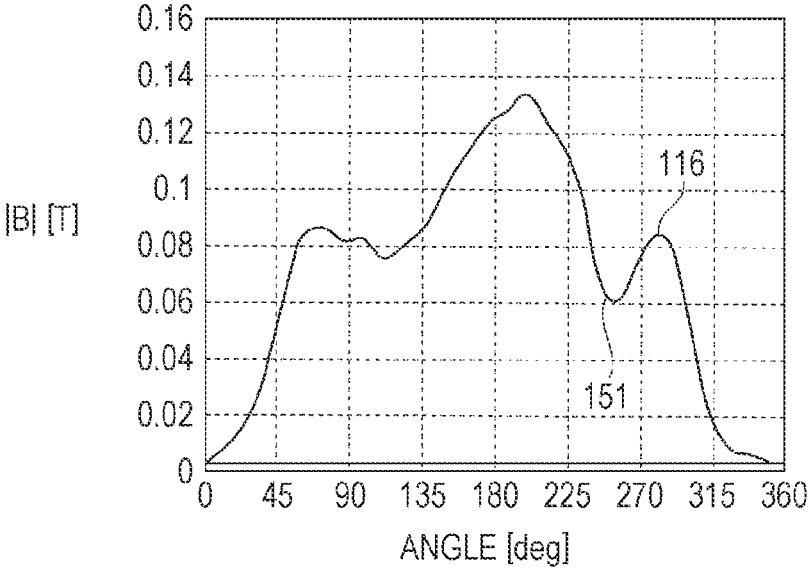
FIG. 10A is a graph illustrating the absolute value |B| of the magnetic flux density of the first magnet roller of the first development roller in the circumferential direction of the first magnet roller when the first development roller is independently disposed.
Figure 10B:
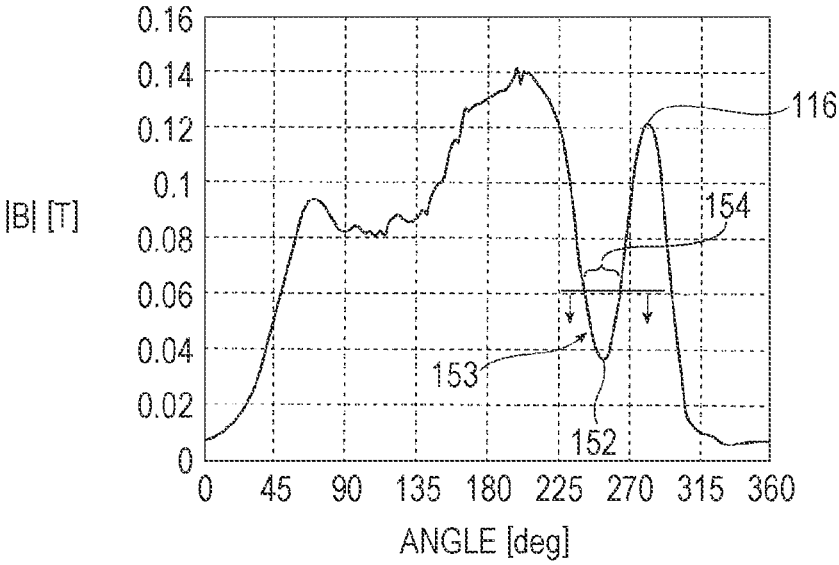
FIG. 10B is a graph illustrating the magnetic flux density of the first magnet roller in the circumferential direction of the first magnet roller when the first and second development rollers are disposed so as to face each other with a small distance therebetween.

FIG. 10A is a graph illustrating the absolute value |B| of the magnetic flux density along the circumferential direction of the first magnet roller 107 of the of the first development roller 105 when the first development roller 105 is independently disposed as illustrated in FIG. 4. FIG. 10B is a graph illustrating the absolute value |B| of the magnetic flux density along the circumferential direction of the first magnet roller 107 of the first development roller 105 when the first and second development rollers 105 and 106 are disposed so as to face each other with a small distance therebetween as illustrated in FIG. 8.

As is clear from FIGS. 10A and 10B, there is a region 151 in which the absolute value |B| of the magnetic flux density of the first magnet roller 107 of the first development roller 105 along the circumferential direction locally decreases. The region 151 is located downstream of the facing magnetic pole 116 (S3) in the rotation direction of the first development sleeve 109. When the first and second development rollers 105 and 106 are disposed so as to face each other with a small distance therebetween, the magnetic flux densities of the facing magnetic poles are considerably increased, and there is a region 153 in which the absolute value |B| of the magnetic flux density locally decreases considerably to a minimal value 152, which is smaller than that of the case where the first development roller 105 is independently disposed. The region 153 is located downstream of the facing magnetic pole 116 in the rotation direction of the first development sleeve 109.

Figure 11:
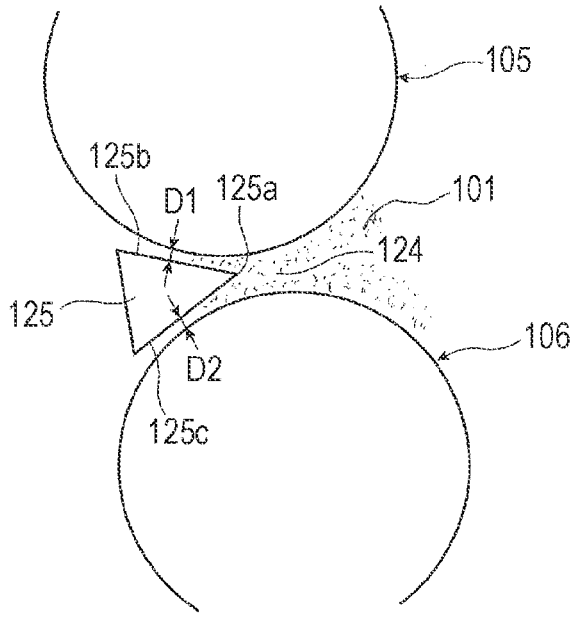
FIG. 11 is a schematic view illustrating a gap between the first and second development rollers.

As described above, the present exemplary embodiment includes the separation member 125 that separates the developer 101, whose layer thickness has been regulated by the trimming member 123, so that the developer 101 is supplied toward the first development roller 105 and toward the second development roller 106. The separation member 125 is disposed such that the distances D1 and D2 between the separation member 125 and the first and second development rollers 105 and 106 are the smallest in the region 151, which is determined by analyzing the combined magnetic field of the facing magnetic poles of the first and second development rollers 105 and 106. The region 151 a region in which the magnitude of the combined magnetic field of the facing magnetic poles locally decreases as compared with the case where at least the development roller 105 is independently disposed, due to the interaction between the facing magnetic poles having opposite polarities. As illustrated in FIG. 11, the separation member 125 has an isosceles triangle cross section, and a vertex 125*a* thereof is located in the facing region 124 at a position at which the facing region 124 is the narrowest. Moreover, the separation member 125 is disposed such that the position at which the distance D1 between the first development roller 105 and the upper surface 125*b* of the separation member 125 is the smallest coincides with the position of the region 150 in FIG. 9 and the position of the minimal value 152 in FIG. 10B. Furthermore, the separation member 125 is disposed such that the position at which the distance D2 between the second development roller 106 and the lower surface 125*c* of the separation member 125 is the smallest coincides with the position of the region 150 in FIG. 9 and the position of the minimal value 152 in FIG. 10B.

The separation member 125 need not be disposed such that the position described above coincides with the position of the minimal value 152 in FIG. 10B. The separation member 125 may be disposed at least in a region 154 in which the absolute value |B| is smaller than the minimal value in the region 151 (in FIG. 10A, about 0.06 T) in the case where the first development roller 105 is independently disposed as illustrated in FIG. 10B.

That is, in the present exemplary embodiment, the separation member 125 having a predetermined shape is disposed such that the distances D1 and D2 between the separation member 125 and the first and second development rollers 105 and 106 are the smallest at a position at which the absolute value |B| of the magnetic flux density of the combined magnetic field of the first and second development rollers 105 and 106 locally decreases to the minimal value 152 as illustrated in FIG. 10B. The position is determined by analyzing the combined magnetic field.

The position of the separation member 125 is not limited to this. As described above, the separation member 125 may be disposed such that the distances D1 and D2 between the separation member 125 and the first and second development rollers 105 and 106 are the smallest in the region 154. The region 154 is located between the facing region 124, in which the first and second development rollers 105 and 106 face each other, and the developing regions, in which the first and second development rollers 105 and 106 face the photoconductor drum 15. The region 154 is a region in which the absolute value |B| of the magnetic flux density of the first and second development rollers 105 and 106 locally decreases to a value smaller than the minimal value in the region 151 to which |B| decreases in the case where the first development roller 105 is independently disposed. The region 154 is determined by analyzing the combined magnetic field.

With the structure described above, the image forming apparatus including the developing device according to the present exemplary embodiment is capable of preventing occurrence of nonuniformity in the layer thickness of the developer that has been separated so as to be supplied toward plural developer carriers.

That is, in the image forming apparatus including the developing device according to the present exemplary embodiment, as illustrated in FIG. 2, in each of the image forming units 13C, 13M, 13HC, 13HM, 13Y, and 13K for cyan (C), magenta (M), high-chroma cyan (HC), high-chroma magenta (HM), yellow (Y), and black (K), the scorotron 16 charges the surface of the photoconductor drum 15. Then, the image exposure device 14 exposes the surface of the photoconductor drum 15 with light in accordance with image data, thereby forming an electrostatic latent image on the surface in accordance with image data. As illustrated in FIG. 1, the developing device 17 develops the electrostatic latent image formed on the surface of the photoconductor drum 15 by using toner of a corresponding color, thereby forming a toner image on the surface of the photoconductor drum 15.

Color toner images formed on the photoconductor drums 15 of the image forming units 13C, 13M, 13HC, 13HM, 13Y, and 13K for cyan (C), magenta (M), high-chroma cyan (HC), high-chroma magenta (HM), yellow (Y), and black (K) are overlappingly first-transferred to the intermediate transfer belt 25. Subsequently, the toner images are simultaneously second-transferred from the intermediate transfer belt 25 to the recording sheet 34 in the second transfer position 50.

After some or all of the toner images of cyan (C), magenta (M), high-chroma cyan (HC), high-chroma magenta (HM), yellow (Y), and black (K) have been simultaneously second-transferred to the recording sheet 34, the fixing device 37 heats and presses the recording sheet 34 to fix the toner image on the recording sheet 34, as illustrated in FIG. 2. Subsequently, the sheet transport unit 40 transports the recording sheet 34 to the cooling unit 41, the cooling unit 41 cools the recording sheet 34, and the curl correction unit 42 corrects a curl of the recording sheet 34. Then, the recording sheet 34 is output to the output tray 43 disposed outside of the image forming apparatus body 1.

At this time, in the developing device 17, as illustrated in FIG. 1, while the developer supply auger 126 and the developer agitation-transport auger 128 agitate and transport the developer 101 contained in the developing device body 104, toner in the developer 101 is negatively charged due to friction between the toner and carrier and the like, and the developer supply auger 126 supplies the developer 101 to the second development roller 106. The second development sleeve 110 of the second development roller 106 rotates and transports the developer 101, which has been supplied to the second development roller 106, in the counterclockwise direction. The trimming member 123 regulates the layer thickness of the developer 101, and the developer 101 is transported to the facing region 124, in which the first and second development rollers 105 and 106 face each other with a small distance therebetween. Then, the separation member 125 separates the developer 101 so that the developer 101 is supplied toward the first development roller 105 and toward the second development roller 106. The developer 101 that has been separated so as to be supplied toward the first development roller 105 is transported in the clockwise direction to the developing region 111, as the first development sleeve 109 of the first development roller 105 rotates. In the developing region 111, in which the first development roller 105 faces the surface of the photoconductor drum 15, the developer 101 is used to develop an electrostatic latent image on the surface of the photoconductor drum 15. Then, the developer 101 is transported in the clockwise direction as the first development sleeve 109 rotates, is peeled off the surface of the first development sleeve 109 by the peel-off magnetic poles. Subsequently, new developer 101 is supplied to the first development roller 105 in the facing region 124, in which the first and second development roller 105 and 106 face each other.

The developer 101 that has been separated so as to be supplied toward the second development roller 106 is transported in the counterclockwise direction to the developing region 135, as the second development sleeve 110 of the second development roller 106 rotates. In the developing region 135, in which the second development roller 106 faces the surface of the photoconductor drum 15, the developer 101 is used to develop the electrostatic latent image on the surface of the photoconductor drum 15. Then, the developer 101 is transported in the counterclockwise direction as the second development sleeve 110 rotates, is peeled off the surface of the second development sleeve 110 by the peel-off magnetic poles. Subsequently, new developer 101 is supplied to the second development roller 106 by the developer supply auger 126.

As illustrated in FIGS. 1, 10B, and 11, in the developing device 17, the separation member 125 having a predetermined shape is disposed such that the distances D1 and D2 between the separation member 125 and the first and second development rollers 105 and 106 are the smallest at a position at which the absolute value |B| of the magnetic flux density of the combined magnetic field of the first and second development rollers 105 and 106 locally decreases to the minimal value 152. The position is determined by analyzing the combined magnetic field. Therefore, the facing magnetic poles and magnetic poles adjacent to the facing magnetic poles have no influence or only a negligible influence on the developer 101 that is separated by the separation member 125 so as to be supplied toward the first development roller 105 and toward the second development roller 106. Thus, irregular movement of the developer 101 from the facing magnetic poles to adjacent magnetic poles or falling of the developer 101 from the first development roller 105 onto the second development roller 106 due to gravity is prevented. As a result, the developer 101 is separated by the separation member 125 so as to be supplied toward the first development roller 105 and toward the second development roller 106 with amounts that are determined by the position of the separation member 125, at which the distances D1 and D2 between the separation member 125 and the first and second development rollers 105 and 106 are the smallest, and thereby occurrence of nonuniformity in the layer thicknesses of the developer 101 separated so as to be supplied toward the development rollers 105 and 106 is prevented.

FIG. 11 illustrates a model of the developing device. The standard deviation of the layer thickness of the developer 101 that is separated so as to be supplied toward the first and second development rollers 105 and 106 is calculated on the basis of this model. As illustrated in FIG. 7, the standard deviation is considerably smaller than that of a related art example, which shows that occurrence of nonuniformity in the layer thickness of the developer 101 separated so as to be supplied toward the first and second development rollers 105 and 106 is prevented.

The value of W×(Bmin/g)×(Bmin/Bg) may be used as an evaluation index for evaluating the standard deviation of the layer thickness of the developer 101 that is separated so as to be supplied toward the first and second development rollers 105 and 106. Here, g is the gap between the development roller and the separation member, Bmin (mT) is the magnetic flux density in a region in which the magnetic flux density between a magnetic pole adjacent to the facing region of the development rollers and a magnetic pole adjacent to the facing region of the photoconductor drum locally decreases, Bg is the magnetic flux density at a position at which the distance between the development rollers and the separation member is g (mm), and W is the width over which the developer 101 is in contact with the surface 125*b* or 125*c* of the separation member 125.

Figure 12:
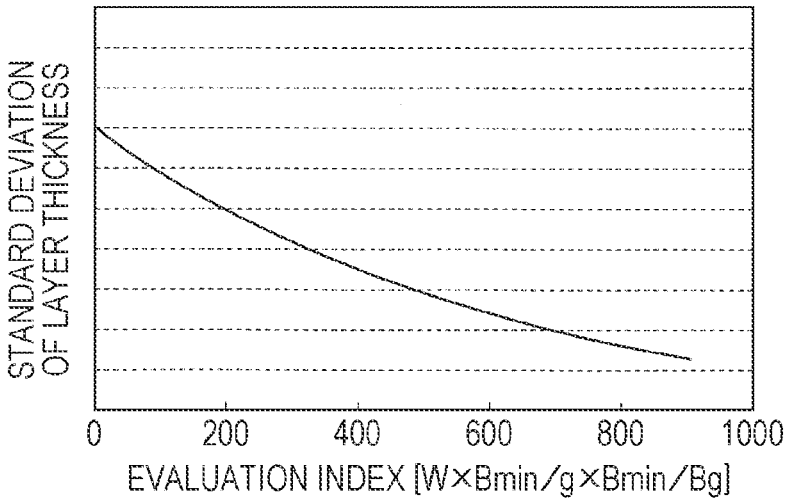
FIG. 12 is a graph illustrating the relationship between an evaluation index and the standard deviation of the layer thickness of developer.

FIG. 12 is a graph illustrating the relationship between the standard deviation of the layer thickness of the developer 101 and the evaluation index.

When the evaluation index is equal to or larger than 300 in FIG. 12, the standard deviation of the layer thickness of the developer 101 is in an appropriate range.

Second Exemplary Embodiment

Figure 13:
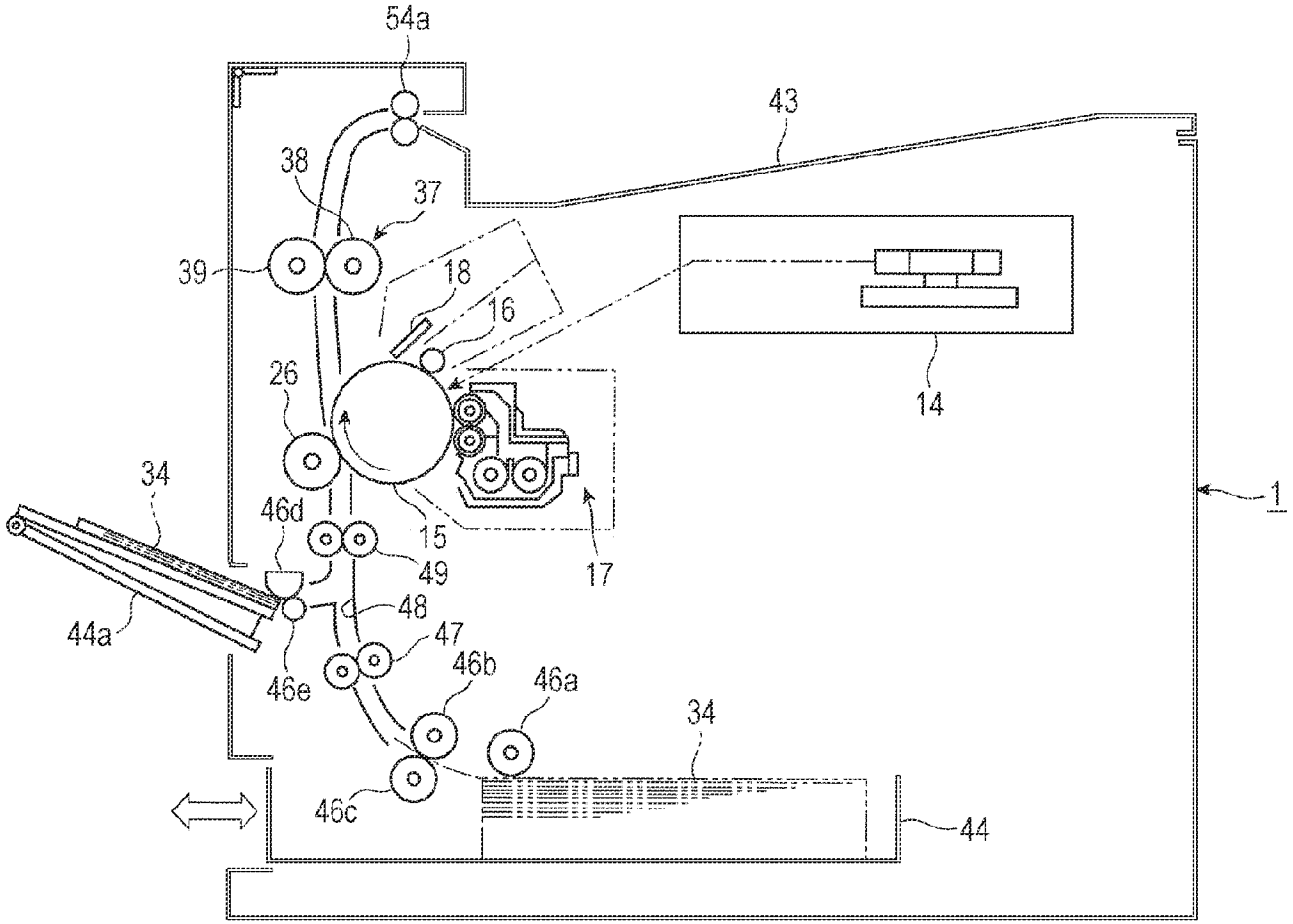
FIG. 13 is a schematic view of an image forming apparatus including the developing device according to a second exemplary embodiment of the present invention.

FIG. 13 illustrates a second exemplary embodiment of the present invention. The same components as those of the first exemplary embodiment will be denoted by the same numerals. The developing device according to the second exemplary embodiment is not included in a tandem full-color image forming apparatus but included in a single-color image forming apparatus having only one image carrier.

As illustrated in FIG. 13, in the second the second exemplary embodiment, only one photoconductor drum 15, which is an example of an image carrier, is disposed in the image forming apparatus body 1 so as to be rotatable in the direction of an arrow. A charging roller 16 serving as a first charger, an image exposure device 14, and the developing device 17 according to the second exemplary embodiment of the present invention are arranged around the photoconductor drum 15.

An electrostatic latent image formed on the surface of the photoconductor drum 15 is developed by the first and second development rollers 105 and 106 of the developing device 17 by using, for example, black (K) toner to form a toner image. A recording sheet 34, which is an example of a recording medium, is supplied from the feed tray 44 after being separated from other sheets by a feed roller 46*a*, a retard roller 46*b*, and a feed roller 46*c*. The toner image is transferred to the recording sheet 34 by the transfer roller 26. The recording sheet 34 may be manually supplied from a manual feed tray 44*a* disposed on a side surface of the image forming apparatus body 1.

The recording sheet 34, to which the toner image has been transferred from the photoconductor drum 15, is heated and pressed by a heating roller 38 and the pressing roller 39 of the fixing device 37, so that the toner image is fixed to the recording sheet 34. Subsequently, the recording sheet 34 is output to the output tray 43 on the upper part of the image forming apparatus body 1 by output rollers 54*a*.

Description of other structures and functions, which are the same as those of the first exemplary embodiment, will be omitted.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a first developer carrier and a second developer carrier that are disposed so as to face an image carrier, the first and second developer carriers facing each other in a facing region with a small distance therebetween, the first and second developer carriers respectively including a first magnetic member and a second magnetic member that are respectively magnetized with a first facing magnetic pole and a second facing magnetic pole that are located in parts of the first and second magnetic members in the facing region, the first and second facing magnetic poles having opposite polarities, and a first cylindrical member and a second cylindrical member that are respectively disposed around outer peripheries of the first and second magnetic members, the first and second cylindrical members rotating in opposite directions from the facing region toward the image carrier;

a regulating member that regulates a layer thickness of developer that is supplied to at least one of the first and second developer carriers; and a separation member that separates the developer, whose layer thickness has been regulated by the regulating member, so that the developer is supplied toward the first developer carrier and toward the second developer carrier, the separation member being disposed such that distances between the separation member and the first and second developer carriers are the smallest in a region in which a magnitude of a combined magnetic field of the first and second facing magnetic poles of the first and second developer carriers locally decreases as compared with a case where at least one of the first and second developer carriers is independently disposed due to interaction between the first and second facing magnetic poles, the region being determined by analyzing the combined magnetic field.

2. The developing device according to claim 1, wherein the separation member is disposed such that distances between the separation member and the first and second developer carriers are the smallest in a specific region between the facing region, in which the first and second developer carriers face each other, and developing regions in which the first and second developer carriers face the image carrier, the specific region being a region in which a magnetic flux density of the combined magnetic field of the first and second developer carriers locally decreases to a value that is smaller than a minimal value to which a magnetic flux density of the first developer carrier locally decreases in the case where the first developer carrier is independently disposed, the specific region being determined by analyzing the combined magnetic field.

3. The developing device according to claim 1, further comprising:

a developer supply member that supplies the developer to the second developer carrier, wherein the regulating member regulates the layer thickness of the developer that is supplied by the developer supply member and carried by the second developer carrier.

4. The developing device according to claim 1, wherein the separation member is disposed such that distances between the separation member and the first and second developer carriers are the smallest at a position at which the magnetic flux density of the combined magnetic field of the first and second developer carriers locally decreases to the minimal value, the position being determined by analyzing the combined magnetic field.

5. The developing device according to claim 1, wherein the first developer carrier is disposed above the second developer carrier, the first developer carrier rotates such that a surface thereof facing the image carrier moves in a direction opposite to a direction in which the image carrier moves, and the second developer carrier rotates such that a surface thereof facing the image carrier moves in a direction the same as the direction in which the image carrier moves.

6. An image forming apparatus comprising:

an image carrier that carries an electrostatic latent image;

a developing unit that develops an electrostatic latent image carried on the image carrier by using toner; and a transfer unit that transfers a toner image to a recording medium directly or through an intermediate transfer member, the toner image having been developed on the image carrier, wherein the developing device according to claim 1 is used as the developing unit.

* * * * *